US005992790A

United States Patent [19]

D'Agnolo

[11] Patent Number: 5,992,790

[45] Date of Patent: Nov. 30, 1999

[54] METHOD OF FINISHING REELS

[75] Inventor: Armando D'Agnolo, Porcia - Pordenone, Italy

[73] Assignee: Officine Meccaniche Riva S.r.l., Oggiono-Lecco, Italy

[21] Appl. No.: 09/099,167

[22] Filed: Jun. 18, 1998

[51] Int. Cl.[6] ..... B65H 54/00; B65H 65/00

[52] U.S. Cl. ..... 242/475.8; 242/125.2; 242/165; 242/172; 57/269; 57/278

[58] Field of Search ..... 242/475.7, 475.8, 242/164, 165, 125.2, 172, 173; 28/290; 57/25, 269, 278

[56] References Cited

U.S. PATENT DOCUMENTS

| | | | |
|---|---|---|---|
| 3,110,450 | 11/1963 | Raasch | 242/475.7 |
| 3,117,738 | 1/1964 | Raasch et al. | 242/475.7 |
| 5,356,085 | 10/1994 | Kobayashi et al. | 242/164 X |

FOREIGN PATENT DOCUMENTS

| | | |
|---|---|---|
| 559041 | 8/1993 | European Pat. Off. . |
| 192562 | 4/1907 | Germany . |
| 187936 | 2/1993 | Germany . |

*Primary Examiner*—Donald P. Walsh
*Assistant Examiner*—Collin A. Webb
*Attorney, Agent, or Firm*—Cowan, Liebowitz & Latman, P.C.; William H. Dippert

[57] ABSTRACT

A method of finishing a reel of wound yarn with a tail end of yarn hanging from the reel can prevent the tail end from becoming caught up and thus unwinding considerable lengths of yarn from the reel and comprises the steps of unwinding a predetermined length of yarn including the tail end, folding the length forming an eye by means of a connection of distinct points on the predetermined length of yarn adjacent the cylindrical surface of the reel, rotating the reel to form at least one rewound turn of yarn including the first connection of points and connecting the eye projecting from the rewound turn to a point of the predetermined length of yarn which is not rewound so as to form a second connection.

26 Claims, 2 Drawing Sheets

METHOD OF FINISHING REELS

FIELD OF THE INVENTION

The present invention relates to a method of finishing a reel of wound yarn with a tail end of yarn hanging from the reel.

BACKGROUND OF THE INVENTION

In the textile industry in general, a problem which is experienced in particular is that of eliminating the so-called tail end of a reel, that is, the portion of yarn which is not wound and hangs from a reel which has just been wound. This problem arises wherever reels of wound yarn are produced, regardless of the nature of the yarn in question.

The current technological trend is in fact towards the automation of the removal of the reels from the frames on which they are wound or from apparatus which winds a single reel.

The automatic removal of the reels is hindered in practice by the their tail ends which risk being caught up, causing undesired unwinding of the yarn which has just been wound.

Moreover, the unwound lengths of yarn, which are often quite long, may become wound around rotating parts of machinery, compromising its operation and, in any case, necessitating manual intervention by an operator to remove the lengths of yarn from the parts on which they are wound or entangled.

These unwound lengths of yarn thus clearly constitute a serious obstacle to any automatic handling and/or transportation of the reels.

This problem is solved with the use of monitoring and possibly a manual removal operation carried out when the winding of a reel is completed and/or when it is removed from the respective winding frame.

An automatic system which grips the end of the yarn and winds it onto a portion of cop projecting laterally from the wound reel has also been proposed.

However, this operation does not involve any actual fixing and the yarn therefore often unwinds from its position, again becoming a nuisance. The presence of operators ready to intervene manually in case of need therefore remains essential.

The technical problem upon which the present invention is based consists in devising a method of finishing reels of wound yarn which overcomes the problems mentioned above with reference to the prior art.

SUMMARY OF THE INVENTION

The concept upon which the invention is based consists in associating the tail end of yarn of a reel with the last turn wound on the same reel so as to form a closed loop surrounding the reel.

In the light of this idea, the above-mentioned problem is solved by a finishing method of the type specified above, which comprises the steps of:

- unwinding a predetermined length of yarn of the reel, including the tail end,
- folding a portion of the predetermined length onto itself so as to form an eye by means of a first connection of points of the predetermined length,
- rotating the reel in order to form at least one rewound turn of yarn including the first connection of points, and
- connecting the eye projecting from the rewound turn to a point of the predetermined length of yarn so as to form a second connection.

The point of the yarn to which the eye is connected is preferably in the part of the predetermined length which is not rewound.

One of the advantages of the finishing method according to the invention is that it permits safe and true automation of the operations for removing reels from the respective winding frames.

In fact, this method prevents the free tail end from becoming caught at some point during any subsequent movement of the reel, causing unwinding of longer or shorter but sometimes very long lengths of yarn which may become caught in the machinery.

According to a further aspect of the method according to the invention, suitable cutting of the tail end of the yarn and of an eye formed thereby produces an easily identifiable indication of the presence of the tail end which frequently, particularly with some kinds of yarn, remains indistinct in the mass of wound yarn.

In this case, the finding and the manual or automatic gripping of the tail end of the yarn during subsequent use of the reel is facilitated.

BRIEF DESCRIPTION OF THE DRAWINGS

Further characteristics and advantages of the method according to the invention will become clear from the description of a preferred embodiment thereof, given by way of non-limiting example, with reference to the following drawings.

DETAILED DESCRIPTION OF THE PREFERRED EMBODIMENT

With reference to the aforementioned drawings, a reel of wound yarn, with a predetermined axis X—X is generally indicated 1.

Figure 3:
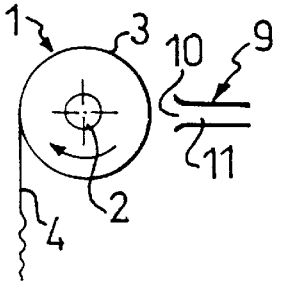
FIGS. 3 to 11 show schematically the various steps of the method according to the invention.
Figure 4:
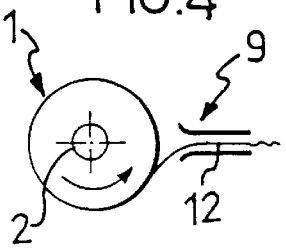

The reel 1 comprises a cop 2 around which the yarn is wound and a cylindrical surface 3. The reel 1 also has a tail end 4 constituted by an end portion of yarn which is not wound and hangs from the reel 1, as shown in FIG. 3.

The reel 1 is supported by means of centers 5 and 6 suitably fitted in the respective open ends of the cop 2 and projecting relative to the yarn wound in the reel 1.

The centers 5 and 6 are supported by respective support arms 5' and 6' which are movable to permit the necessary movement of the centers 5 and 6 towards or away from one another in order actually to grip the reel 1 between the centers 5 and 6. The arms may also be movable to allow the reels to be gripped and lifted from the respective winding frame.

Figure 1:
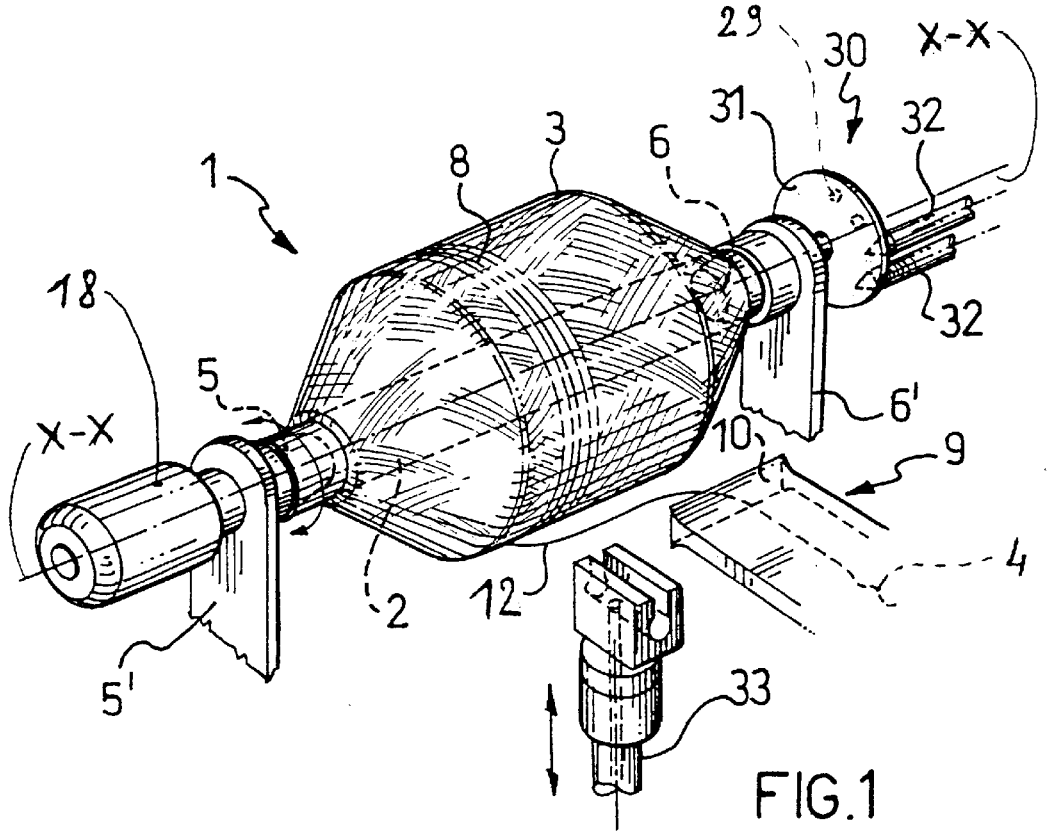
FIG. 1 is a perspective view of a reel during the implementation of the method according to the invention.

In the embodiment of FIG. 1, one of the two centers, the center 5 in the example shown, is driven by a motor 18 so that the reel can be rotated suitably both in the yarn-winding direction and in the unwinding direction.

The other center 6 is fixed to the cop 2 and is mounted idly on the respective arm 6' so as to be rotated by the reel 1 during rotation.

Figure 2:
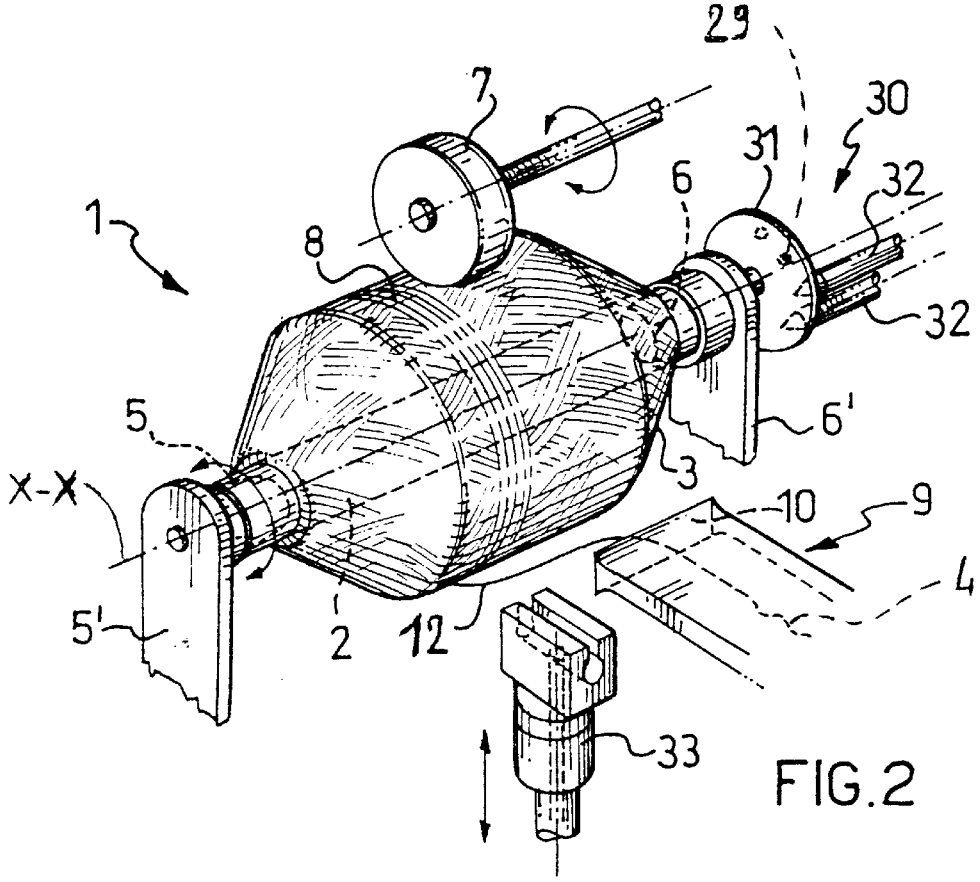
FIG. 2 is a perspective view of a reel during the implementation of the method according to the invention, with a different drive mechanism.

In the embodiment of FIG. 2, a drive roller 7 bears against the cylindrical surface 3 of the reel 1 and is driven in order to impart to the reel a suitable rotation both in the yarn-winding direction and in the unwinding direction, as in the embodiment of FIG. 1. In this second embodiment, both of the centers 5 and 6 are fixed to the cop 2 and are mounted idly on the respective arms 5' and 6' so as to be rotated by the reel 1.

The reel 1 is advantageously associated with means 30 for detecting its angular position.

In both of the embodiments of FIGS. 1 and 2, the detection means 30 comprise a detection disc 31 fixed for rotation with the idle center 6. The disc 31 is thus rotated by the motion of the reel 1 and its angular position is unequivocally related to that of the reel 1.

The disc 31 incorporates elements representative of the angular position of the reel, for example, metal plates 29 located at a predetermined angular spacing.

The detection means 30 also comprise one or more position sensors 32 which can detect the representative elements and are constituted, for example, by so-called proximity sensors, cooperating with the metal plates 29.

It is intended that the representative elements and the corresponding position sensors 32 may also be of different kinds, for example, operating optically, magnetically or by mechanical interference.

The winding of the yarn on the reel 1 is advantageously concluded with a few turns, generally indicated 8, disposed close together and located on the cylindrical surface 3 of the reel 1.

The turns 8 extend in a plane substantially perpendicular to the axis of the reel 1 and are preferably positioned centrally on the cylindrical surface 3 of the reel 1.

Suction means 9 for the wound yarn, comprising a suction opening 10 and a suction duct 11, act on the surface 3 of the reel 1 and, in particular, in the region of the turns 8.

The suction means 9 generate an air-flow which draws the yarn hanging from the reel 1 through the opening 10 into the suction duct 11. The portion of yarn unwound from the reel 1 is thus kept extended with a predetermined tension along a predetermined axis defined by the air-flow.

The air-flow in the suction means 9 can be interrupted according to the requirements of the method according to the invention.

The opening 10 can also be moved forwards and backwards between an advanced position relative to the surface 3 of the reel 1, in which the yarn is drawn in, and a retracted position which permits operation on the portion of the yarn which remains extended between the opening 10 and the reel 1.

The method according to the invention provides for the use of means 33 for connecting distinct portions or points of the yarn.

"Connection" or "joining" means any type of connection between yarns, such as knotting, heat-sealing in the case of synthetic fibers, gluing, the application of fastening means such as clips, ties, or the like and, in particular, interlacing or splicing.

"Interlacing" or "splicing" generally means a connection of ends of yarn formed by means of turbulence generated with compressed air which causes the fibers of the yarns to intermingle. This connection is generally used in automatic reeling or for joining head and tail ends of reels.

FIGS. 1, 2, 5 and 11 show the splicing or interlacing connection means 33 comprising a connection head movable between a rest position and an operative position in which the connection head is inserted between the reel 1 and the opening 10 in order to connect the yarns.

The implementation of the method of finishing reels 1 will be described below, step by step, with reference to FIGS. 3 to 11.

FIG. 3 shows the starting position of the reel 1 located with the surface 3 facing the opening 10 of the suction means 9 and with the tail end 4 hanging. The length of the tail end 4 at this stage is indeterminate.

In the present embodiment of the method according to the invention, the end 4 and the opening 10 are disposed on opposite sides of the reel 1. This representation is not limiting of the definition of the method.

The opening 10 is moved towards the central turns 8 in a centered position relative to the surface 3 of the reel 1.

At this stage, as already indicated, the length of the tail end 4, which might even be caught up, is not known. In this connection, the reel 1 is rotated for a few turns so that the tail end 4 is wound onto the reel 1.

The reel 1 is then unwound (FIG. 4) until a predetermined length 12 of yarn is unwound, the length 12 comprising the tail end 4 and being long enough to enable the subsequent steps to be carried out, as will become clearer from the following description.

The length 12 is obtained by imparting a suitable rotation to the reel 1 in the yarn-unwinding direction by means of the motor 18 (FIG. 1) or the drive roller 7 (FIG. 2), according to the embodiment considered.

As stated above, the air-flow generated by the suction means 9 in the advanced position (FIG. 4) enables the length 12 of yarn to be kept extended with a predetermined tension both between the reel 1 and the opening 10 and in the downstream portion.

Figure 5:
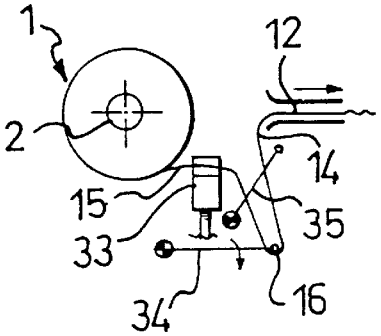

The method then comprises a step in which an intermediate portion of the length 12 is folded onto itself so as to form an eye 13 closed by a first connection 20, in the sense defined above, of a first point 14 of the length 12 of yarn and a second point 15 closer to the reel 1 (FIG. 5).

To achieve the folding, a point 16 of the yarn which is between the two points 14 and 15 and is to constitute the end of the eye 13 is gripped and pulled to a position removed from the air-flow generated by the suction means (FIG. 5). The length 12 of yarn thus forms a loop.

The gripping is achieved by a first arm 34 which, by pivoting in accordance with a pre-arranged sequence, intercepts the length 12 of yarn at-the point 16 in order to pull it to the removed position.

At this stage, the reel 1 is kept stationary in a predetermined position detected by the detection means 30, whilst the opening is brought to the retracted position to allow the first arm 34 to operate without interfering with it.

A second arm 35 then pivots so as to intercept the first point 14 of the yarn and to superimpose it on the second point 15 which, as stated, is close to the cylindrical surface 3 of the reel 1. The loop formed between the points 14 and 15 of the yarn is consequently closed onto itself, forming the eye 13.

Figure 6:
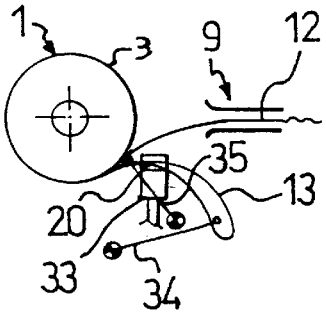
Figure 7:
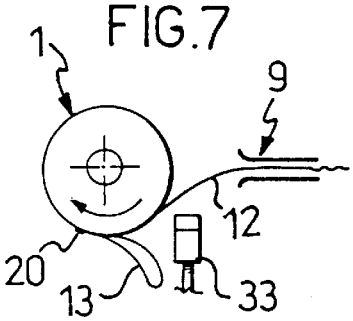

The connection head 33 is then brought to the operative position where it forms the first connection 20 of the points 14 and 15 by splicing of the fibers which make up the yarn (FIG. 6).

Figure 8:
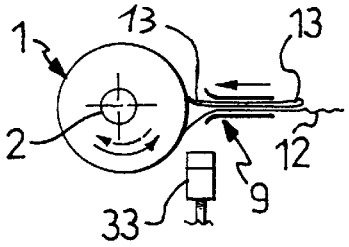
Figure 9:
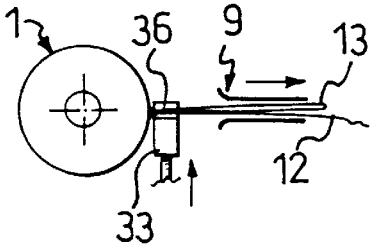

The reel 1 is then rotated in the yarn-winding direction for a finite number of revolutions, preferably one revolution, so as to wind the first connection 20 and the eye 13 (FIG. 7) around the reel. With the control of the detection means 30, the reel 1 is repositioned in a manner such that the first connection 20 and the eye 13 are disposed adjacent the opening 10 (FIG. 8). This rotation forms, around the reel 1, at least one rewound turn formed by the yarn of the length 12 and including both the first connection 20 and the eye 13.

Once the reel 1 has been repositioned and the eye 13 has reached the position described above, the opening 10 is brought back to the advanced position relative to the surface 3 of the reel 1. The eye 13 is thus drawn in by the suction means 9 until it is disposed adjacent the length 12 of yarn which has not been rewound and is still drawn in (FIG. 8).

To facilitate the drawing-in of the eye 13, the reel 1 may be rotated backwards and forwards about the stopping position.

At this point (FIG. 9), the opening 10 is moved away form the surface 3 of the reel, whilst the connection head is brought to the operative position in order for the eye 13 to be connected, preferably at the point 20, to a still unwound point of the predetermined length 12 of yarn so as to form a second connection 36 close to the surface 3 of the reel 1. The connection takes place by interlacing or splicing in the sense defined above.

As an alternative to what has been described, the eye 13 may be connected to a different turn of the reel 1 and, in particular, to a rewound turn comprising a second eye formed by means of a further connection of separate points of the predetermined length 12.

Figure 10:
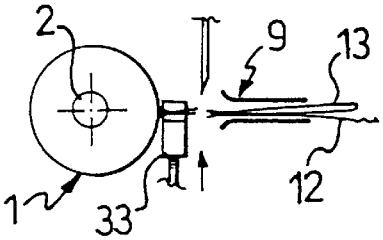
Figure 11:
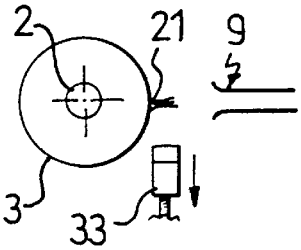

The method according to the invention then comprises the step of cutting the eye 13 and the length 12 of yarn which has not been rewound, both of which are kept extended by the air-flow, the cutting taking place close to the second connection 36 and, in particular, downstream thereof (FIG. 10). As well as preventing the reel 1 from unwinding, the second connection 36 constitutes an indication 21 of the presence of the end of the yarn on the cylindrical surface 3 of the reel 1. In the embodiment considered herein, the indication 21 is formed by a tuft of three cut ends of yarn (FIG. 11).

The cut-off portions of yarn, the eye 13 and the rest of the length 12 of yarn which is not rewound are removed by the air-flow through the opening 10.

The reel 1 thus finished is ready to be stored or sent for subsequent processing.

In the light of the foregoing description, it is clear that the length of the length 12 depends on the number of revolutions in the winding direction imparted to the reel 1 once the eye 13 has been formed, on the travel of the first arm 34 which pulls the end 16 of the eye 13, and on the safety margin allowed.

With a sufficiently long predetermined length 12, it is possible to omit the monitoring means 30, and to arrange for the reel 1 to rotate automatically, without monitoring.

Moreover, by suitable positioning of the opening 10 and/or by increasing its transverse dimensions, it is also possible to avoid the provision of the central turns 8 for facilitating gripping of the tail end 4.

As can be seen from the method described above, its application is limited neither by the type of yarn nor by the type of reel; it can be implemented with both continuous and discontinuous yarns, made of synthetic or natural filaments, such as cotton, wool, silk, acrylics, polyesters, polyamides, and the like.

Moreover, it can be adapted to very varied reel-production situations and the reels may be cylindrical, tapered, conical, etc.

Moreover, the method according to the invention is preferably used when the removal of the wound reels is carried out on robots which pick up the reels discharged from their positions in order to deposit them on carriages or in checking and packaging stations as, for example, in textile machines, or where removal takes place by means of automatic carriages as in so-called "open end" reeling machines or automatic spooling machines which serve a large number of winding stations.

In order to satisfy further and contingent requirements, an expert in the art may apply to the above-described method of finishing reels many further modifications and variations all of which, however, are included within the scope of protection of the present invention, as defined by the following claims.

What is claimed is:

1. A method of automatically finishing a reel of wound yarn having a free tail end, comprises the steps of:

unwinding a predetermined length of yarn of the reel, including the tail end, folding a portion of the predetermined length onto itself so as to form an eye (by means of a first connection of points of said predetermined length, rotating the reel in order to form at least one rewound turn of yarn including said first connection of points, and connecting the eye projecting from the rewound turn to a point of said predetermined length of yarn so as to form a second connection.

2. A method according to claim 1, comprising the step of cutting the length of yarn downstream of the second connection.

3. A method according to claim 2, comprising the step of cutting the eye to form an indication of the presence of the end of yarn on the cylindrical surface of the reel.

4. A method according to claim 1, comprising the step of cutting the eye to form an indication of the presence of the end of yarn on the cylindrical surface of the reel.

5. A method according to claim 1, in which the point at which the eye is connected is disposed in the part of the predetermined length which is not rewound.

6. A method according to claim 1, in which the portion of said predetermined length to be folded onto itself is spaced from the tail end.

7. A method according to claim 6, in which the portion of said predetermined length to be folded onto itself is the portion which is close to the cylindrical surface of the reel.

8. A method according to claim 1, in which the second connection is formed adjacent the first connection.

9. A method according to claim 1, in which the predetermined length of yarn is kept extended by a predetermined tension along a predetermined axis during the formation of the eye.

10. A method according to claim 9, in which the predetermined length of yarn is folded by:

gripping a point of the yarn which is disposed between the points and is to become the end of the eye, and pulling it away from the predetermined axis so as to form a loop, and superimposing a first of the points on the second of the points.

11. A method according to claim 10, in which the first point of the yarn is further downstream than the second point, relative to the reel.

12. A method according to claim 1, in which the predetermined length of yarn is kept extended by a predetermined tension by suction in an air-flow.

13. A method according to claim 12, in which the cut-off portions of yarn are moved away by the air-flow.

14. A method according to claim 1, in which the rotation of the reel is imparted by means of a driving center of two centers supporting a cop of the reel.

15. A method according to claim 1, in which the rotation of the reel is imparted by means of a drive roller acting by friction on the cylindrical surface of the reel.

16. A method according to claim 1, in which the first or second connection is formed by interlacing or splicing of the fibers making up the yarn.

17. A method according to claim 1 in which the first connection or the second connection is formed by heat sealing.

18. A method according to claim 1 in which the first connection or the second connection is formed by gluing.

19. A method according to claim 1 in which the first connection or the second connection is formed by knotting.

20. A method according to claim 1 in which the first connection or the second connection is formed by fastening means.

21. A method according to claim 1, in which the winding of the yarn on the reel is concluded by end turns disposed close together and located on the cylindrical surface of the reel.

22. A method according to claim 21, in which the end turns extend in a plane substantially perpendicular to the axis of the reel.

23. A method according to claim 22, in which the end turns are positioned centrally on the cylindrical surface of the reel.

24. A method according to claim 1, in which angular-position detection means are associated with the reel.

25. A method according to claim 24, in which the detection means comprise a detection disc associated with one center so as to be fixed for rotation with the center and representative of the rotation thereof.

26. A method according to claim 24, in which the disc incorporates elements representative of the angular position of the reel, the detection means also comprising one or more position sensors which can detect the representative elements.

* * * * *